US005671926A

United States Patent [19]

Hagey

[11] Patent Number: 5,671,926

[45] Date of Patent: Sep. 30, 1997

[54] TENNIS RACKET WITH ENHANCED HAND GRIP

[76] Inventor: Edward H. Hagey, 3653 Jennifer St., San Diego, Calif. 92117

[21] Appl. No.: 459,302

[22] Filed: Jun. 2, 1995

Related U.S. Application Data

[63] Continuation-in-part of Ser. No. 363,606, Dec. 18, 1994, Pat. No. 5,492,324.

[51] Int. Cl.[6] ..... A63B 49/08

[52] U.S. Cl. ..... 273/73 J

[58] Field of Search ..... 273/735, 75, 818, 273/810

[56] References Cited

U.S. PATENT DOCUMENTS

| | | | |
|---|---|---|---|
| 412,479 | 10/1889 | Davis | 273/75 |
| 2,302,191 | 11/1942 | Covington | 273/73 J |
| 4,065,127 | 12/1977 | Fagan | 273/81 D |
| 4,067,573 | 1/1978 | Key | 273/81 B |
| 4,213,609 | 7/1980 | Swanson | 273/75 |
| 4,355,803 | 10/1982 | Rama | 273/73 J |
| 4,438,925 | 3/1984 | Lindstrom | 273/73 J X |
| 4,641,838 | 2/1987 | Gabrielidis | 273/73 J |
| 4,963,032 | 10/1990 | Redekop | 273/73 J X |
| 5,295,684 | 3/1994 | Bracho | 273/73 J |
| 5,316,316 | 5/1994 | Lai | 273/7 J |
| 5,322,278 | 6/1994 | Jeanrot | 273/73 J X |
| 5,398,930 | 3/1995 | Gibson | 273/81 B |
| 5,460,372 | 10/1995 | Cook | 273/81 B |

FOREIGN PATENT DOCUMENTS

| | | | |
|---|---|---|---|
| 519312 | 12/1992 | European Pat. Off. | 273/73 J |
| 2232337 | 1/1975 | France | 273/75 |
| 3628618 | 11/1987 | Germany | 273/73 J |
| 3726753 | 2/1989 | Germany | 273/73 J |
| 3733425 | 2/1989 | Germany | 273/73 J |
| 3842126 | 8/1990 | Germany | 273/73 J |
| 4019039 | 12/1991 | Germany | 273/73 J |
| 662110 | 5/1979 | U.S.S.R. | 273/73 C |
| 20882 | 11/1908 | United Kingdom | 273/81 B |
| 8902297 | 3/1989 | WIPO | 273/735 |

*Primary Examiner*—William E. Stoll
*Attorney, Agent, or Firm*—John J. Byrne

[57] ABSTRACT

An attachment for a tennis racket handle comprises a structure forming an enlarged handle portion of the handle shaft having a second width dimension that is larger than the first width dimension and a second depth dimension, the structure having side edges forming a handle transition portion of the handle shaft diverging at an angle of between about ten and twenty degrees from the first to the second handle portions toward the head providing a transition between the first and second width dimensions, the structure forming front and back faces corresponding to faces of the racket head, the front and back faces formed with substantially flat surfaces with a rounded ridge along a face of one embodiment. Another embodiment includes a protrusion on one side edge for engagement with a forefinger.

11 Claims, 7 Drawing Sheets

TENNIS RACKET WITH ENHANCED HAND GRIP

REFERENCE TO RELATED APPLICATIONS

The present application is a continuation-in-part of Ser. No. 08/363,606 filed Dec. 18, 1994, now U.S. Pat. No. 5,492,324, and entitled "TENNIS RACKET WITH ENHANCED HANDLE KIT".

BACKGROUND OF THE INVENTION

The present invention is directed generally to tennis rackets, and more particularly to an improved hand grip for tennis rackets.

Tennis rackets are conventionally equipped with a hand grip that is octagonal in shape and sized to support a player's hand(s) for single-handed forehand strokes and single-handed or double-handed backhand strokes. The hand grip of many tennis rackets is formed by wrapping a gripping tape winding around a plastic sleeve that is slidably mounted over the shaft of the racket or formed thereon. The hand grip generally extends for about 7½ inches from the base of the racket shaft and is of uniform dimension throughout its length. The circumferential size of the standard octagonal hand grip for junior to adult tennis rackets typically varies from about 4 inches to about 4⅝ inches.

A disadvantage of conventional tennis racket hand grips is that they do not optimally conform to the configuration of the human hand such that the appreciable inertia generated by swinging the racket is not efficiently resisted by the player in the area of the hand, wrist and forearm. These inertial forces are particularly pronounced in newer rackets having enlarged racket head sizes. Because the size of the hand grip in prior art rackets is generally uniform over the length of the grip, the player's hand is not positioned to fully control such forces.

Accordingly, there is an evident need in the art for a tennis racket and tennis racket grip therefor that overcomes the foregoing disadvantages in a novel and innovative fashion. What is required is a tennis racket in which the effects of inertial forces generated by swinging the racket are minimized by providing an alternative to conventional hand grips of uniform size.

SUMMARY AND OBJECTS OF THE INVENTION

It is the primary object of the present invention to provide an improved racket grip enables better grip and control of the racket.

In accordance with a primary aspect of the present invention a tennis racket having a racket head and a handle shaft extending from said racket head, said handle shaft having a substantially uniform first handle portion including a first width dimension and a substantially uniform first depth dimension, an improved tennis racket handle kit, comprises a structure forming an enlarged handle portion of said handle shaft having a second width dimension that is larger than said first width dimension and a second depth dimension, said structure having side edges forming a handle transition portion of said handle shaft diverging at an angle of between about five and twenty-five degrees from said first to said second handle portions toward said head providing a transition between said first and second width dimensions, said structure forming front and back faces corresponding to faces of the racket head, said front and back faces formed with substantially flat surfaces with one preferred embodiment comprising a ridge extending along one of said faces at about said diverging angle. In another embodiment a protrusion is disposed on one of said side edges for engagement by an index finger.

BRIEF DESCRIPTION OF THE DRAWINGS

My invention can be more clearly understood by reference to the following detailed disclosure and the accompanying drawing in which:

FIG. 9*b* is a partial rear view of the tennis racket handle configuration of FIG. 9*a;*

DETAILED DESCRIPTION OF THE PREFERRED EMBODIMENTS

Figure 1:
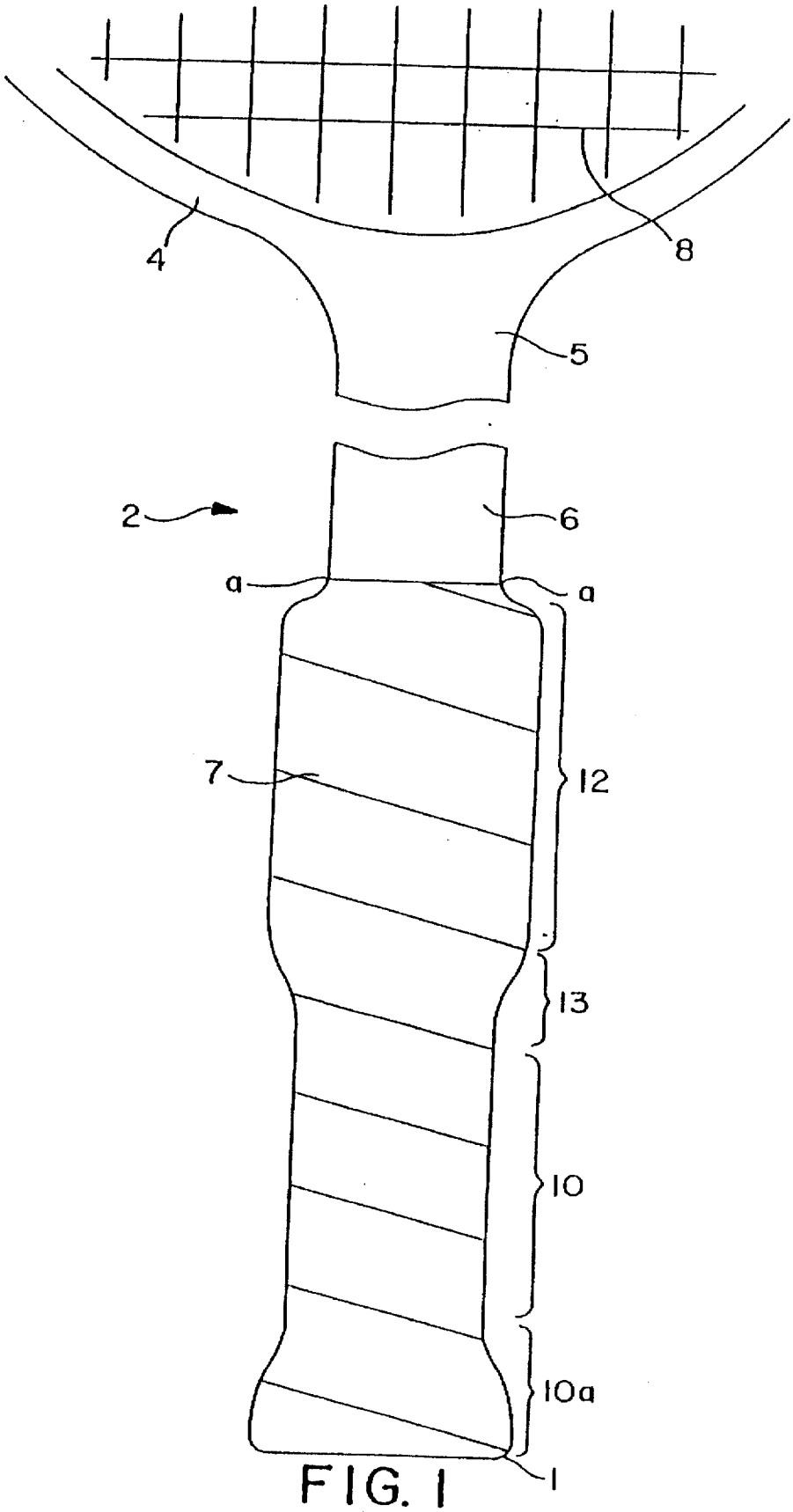
FIG. 1 is a partial plan view of an idealized tennis racket incorporating a tennis racket handle kit constructed in accordance with one aspect of the present invention.
Figures 3, 4:
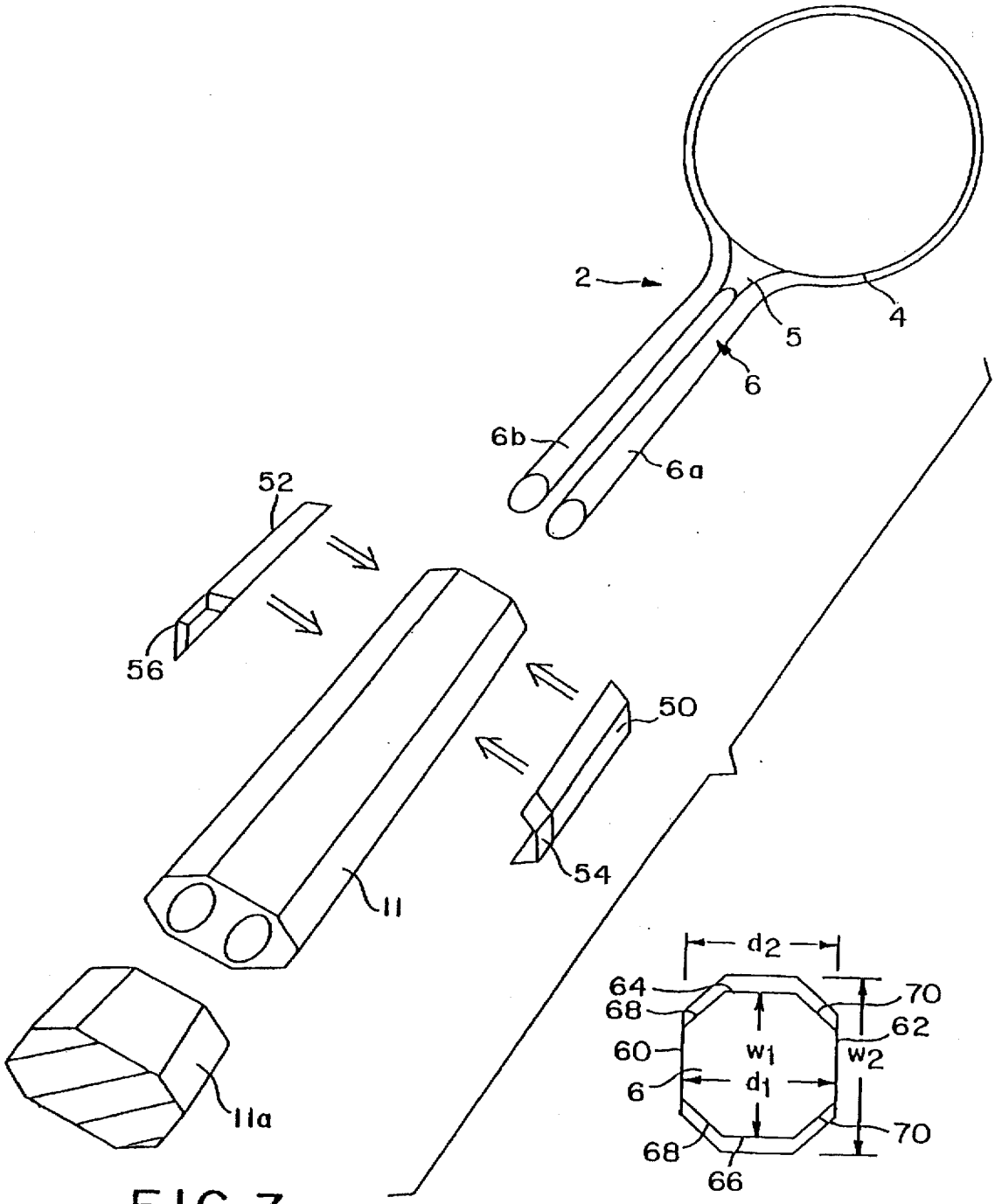
FIG. 3 is an exploded perspective view showing the components that could be used to construct the tennis racket of FIG. 1.
FIG. 4 is a cross-sectional view showing a portion of the handle shaft of the tennis racket of FIG. 1.

Referring now to FIG. 1, a tennis racket 2 has a racket head 4, a throat area 5 and a handle shaft 6 extending from the racket head. The racket head may be of any conventional size and includes the usual gut or synthetic string webbing 8 that provides a resilient striking surface for addressing a tennis ball. The handle shaft 6 is covered by a tape wrapping 7 extending between points "a" and "b" on the handle shaft. The handle shaft 6 further includes a first handle portion 10 that is octagonal in shape, as is conventional. The shape of the handle portion 10 is defined by either the surface of the handle shaft itself, or by a plastic sleeve 11 (see FIG. 3), that is mounted on the handle shaft 6, if one is present. The racket head 4 and the handle shaft 6 can be made from wood, composite fiber material or metal, as is known in the art. As shown in FIG. 4, the handle portion 10 includes a substantially uniform first width dimension w1 and a substantially uniform first depth dimension d1. If a plastic sleeve 11 is used to define the handle portion, it can be configured to provide a slightly flared element 10*a* defined at the base of the handle shaft 10. Alternatively, as is more conventional, the flared element could be provided as a rubber or plastic sleeve 11*a* that mounts over the principal sleeve 11.

Figure 2:
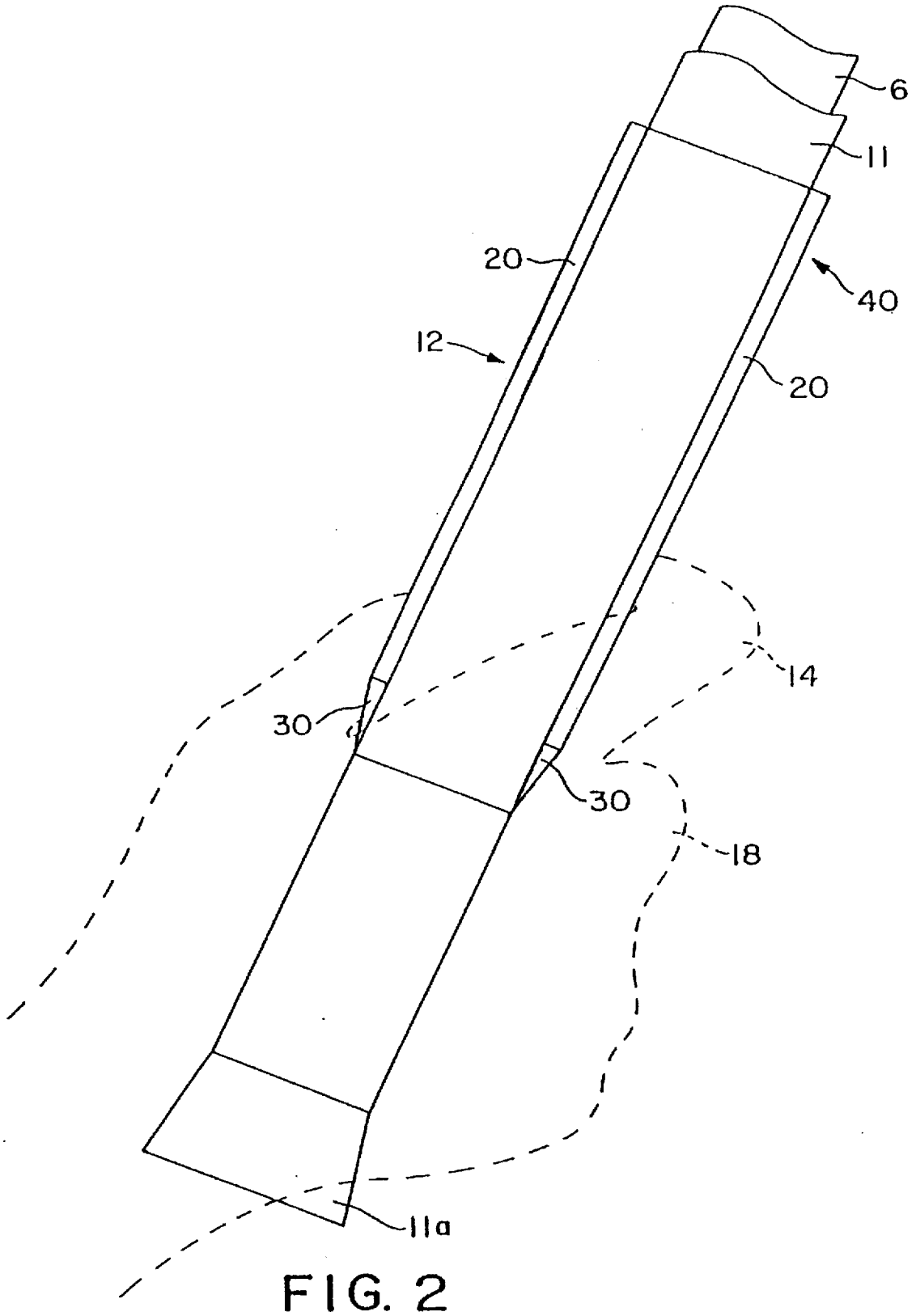
FIG. 2 is a diagrammatic partial perspective view showing the tennis racket of FIG. 1 being gripped by a tennis player.

As shown in FIGS. 1 and 2, the problem of resisting inertial racket forces in order to improve player control over the racket is solved by providing a kit for forming a second, enlarged racket handle portion 12 of the handle shaft 6. The enlarged handle portion 12 allows a tennis player to position the forefinger 14 of the player's hand 16 upwardly and away from the remaining fingers 18. This position provides the player with enhanced control over the movement of the racket during all phases of the game including service, and forehand and backhand ground and overhead strokes.

In order to achieve this intended effect, the enlarged handle grip portion 12 is formed from a handle kit that includes a first structure 20. As shown in FIGS. 2 and 4, the enlarged handle portion 12 has a substantially uniform second width dimension w2 that is larger than the first width dimension w1 and a substantially uniform second depth dimension d2 that is substantially equal to the first depth dimension d1. A second structure 30 (see FIG. 2) is further provided for forming a handle transition portion 13 of the handle shaft, between the first and second handle portions 10 and 12, that tapers between the first and second width dimensions w1 and w2. Any conventional covering, such as the tape wrapping 7 (see FIG. 1), can be provided for covering the first and second structures 20 and 22.

The first enlarged handle portion structure 20 and second handle transition portion structure 30 can be formed in a variety of ways. First, they could be integrally fabricated with the handle shaft 6 during racket manufacture, in which case the handle kit of the present invention would be integrally incorporated into the racket 2 by the manufacturer. This technique could be used for a variety of racket materials including aluminum, resin-impregnated fiber and wood, with the handle kit being formed by appropriate shaping of the handle material during manufacture. Another way to form the enlarged handle structure 20 and second handle transition portion structure 30 would be to integrate these structures as part of the sleeve 11. Still another way to form the structures 20 and 30 would be to provide these structures as a bendable molded rubber piece 40 that would preferably slide over the handle shaft 6, or the sleeve 11 if present, and could be secured thereto using an adhesive. If the structures 20 and 30 are designed as part of the conventional sleeve 11, the sleeve would integrally provide the first handle portion 10 and the enlarged handle portion 12.

Still another way to form the first and second enlarged handle and handle transition portion structures 20 and 30 would be to form these structures as a pair of resilient inserts 50 and 52 mountable on opposing sides of the sleeve 11, as shown in FIG. 3, or the handle shaft 6 itself. FIG. 3 illustrates that the handle shaft 6 of the tennis racket 2 may be formed from a pair of tubes 6*a* and 6*b* when the racket is made from extruded metal material. The tubes 6*a* and 6*b* are mounted within the sleeve 11. The inserts 50 and 52 could be substantially rectangular strips having a thickness "t" providing an increase in size between the first width dimension w1 and the second width dimension w2, with the increase in size being substantially equal to "2×t." The inserts 50 and 52 include tapered end portions 54 and 56, respectively, that provide the second structure 22 forming the handle transition portion. Advantageously, the first and second structures 20 and 22 can be formed as one or more of the inserts 50 and 52 mounted on opposing sides of the sleeve 11 or handle shaft 6. For example, two or more inserts 50 and 52 could be mounted on each of the opposing sides of the sleeve 11 or handle shaft 6, the number of inserts being selected to provide a total increased thickness between the first width dimension w1 and the second width dimension w2 of "T=2 [t1+t2 . . . +tn]" where "n" is the number of inserts on a side and "t" is the thickness of each insert.

Figure 6:
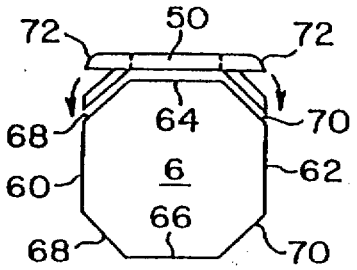
FIG. 6 is a cross-sectional view showing another embodiment of a tennis racket handle kit insert member.

As shown in FIGS. 4 and 6, the sleeve 11 and/or the handle shaft 6 include a pair of racket handle side walls 60 and 62, a pair of racket handle end walls 64 and 66 substantially perpendicular to the side walls, and two pairs of racket handle angled walls 68 and 70 joining the side walls and end walls so as to form a octagonal cross section.

Figure 5:
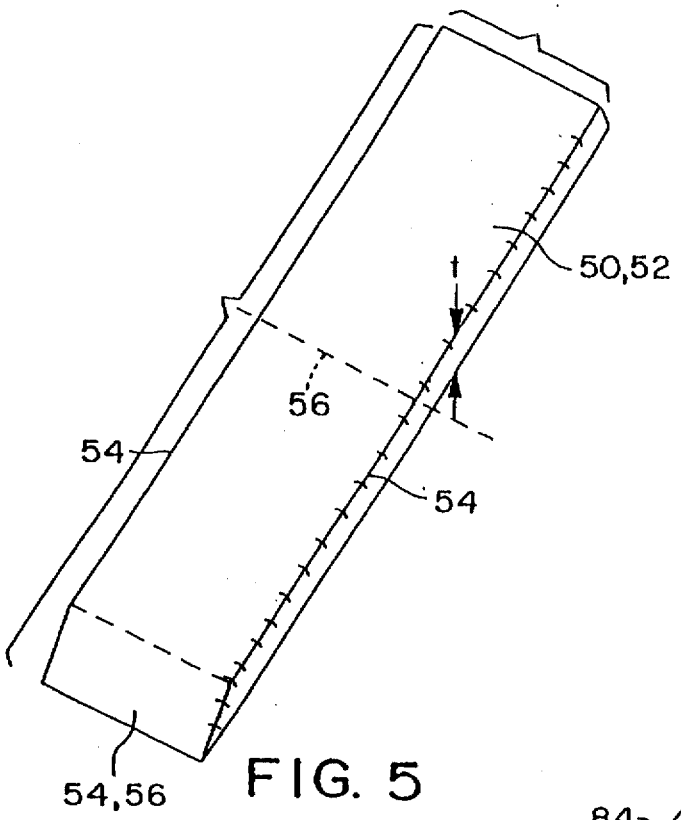
FIG. 5 is a perspective view of one embodiment of a tennis racket handle kit insert member.

As shown in FIG. 5, the inserts 50 and 52 are generally rectangular strips. They can be sized to have a width that is substantially equal to the width of the end walls 64 and 66. In that case, rounded edges 54 can be provided for a comfortable grip. Alternatively, as shown in FIG. 6, the inserts 50 and 52 could be formed as bendable strips having a width that is substantially equal to the width of the end walls 64 and 66 plus the width of two of the angled walls 68 and 70. In that case, the bendable strips 50 and 52 would have angled edges 72 (e.g. 45°) configured to line up with the racket handle side walls 60 and 62 when the strips are placed over the end walls 64, 66 and angled walls 68, 70. Advantageously, the inserts 50 and 52 can be provided with one or more pre-scored "cut" lines 56 so that the inserts can be sized to the player's preference. In this way, the length of the enlarged handle portion 12 can be variably selected, e.g., for single-handed or two-handed play.

Figure 7:
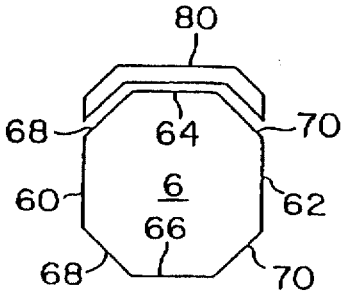
FIG. 7 is a cross-sectional view showing still another embodiment of a tennis racket handle kit insert member.
Figure 8:
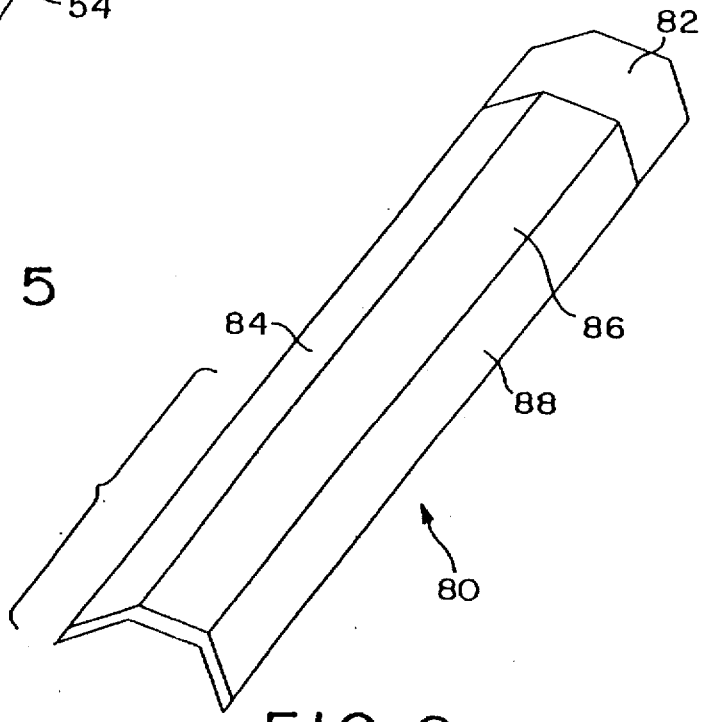
FIG. 8 is a perspective view of the tennis racket handle kit insert member of FIG. 7.

Referring now to FIGS. 7 and 8, the first and second structures 20 and 22 could be formed as one or more pairs of flexible pre-molded inserts 80. Each of the inserts 80 has three walls 84, 86 and 88 configured to mount on one of the racket handle end walls 64 or 66, and the two adjacent angled walls thereof 68 and 70. The inserts 80 have angled edges 90 (45°) configured to line up with the racket handle side walls 60 and 62 when the inserts are placed over the end walls 64, 66 and adjacent angled walls 68, 70. The inserts 80 further include a tapered end portion 82 that provides the handle transition portion of the handle shaft. The inserts 80 are preferably attached to the sleeve 11 or the handle shaft 6 using adhesive. Score lines could be provided for cutting the inserts 80 to length.

As previously described, the tennis racket handle kit of the present invention could be installed and incorporated by the tennis racket manufacturer as part of the manufacturing process. Alternatively, the kit could be separately sold so that a tennis shop, or perhaps a tennis racket owner, could modify an existing conventional tennis racket. In that case, the kit would consist of a set of any of the above-described sleeve or insert structures. In the latter case, the inserts would be mountable on opposing sides of the sleeve 11 or the handle shaft 6. The inserts would have selected thicknesses and could be arranged in layers of one or more inserts on each of the opposing sides of the sleeve 11 or handle shaft 6 to provide an increase in size between the first width dimension w1 and the second width dimension w2, the increase in size being substantially equal to the combined thicknesses of the inserts. A subsequent step in the fabrication of an enlarged racket handle using any of the foregoing kits would include covering a portion of the handle shaft, including the inserts, with a tape wrapping such as the wrapping 7, in order to form a hand grip.

Considering now the tennis racket handle kits of FIGS. 1 and 2, in which w1 and w2 are substantially uniform over the length of the handle, it will be appreciated that the increase in size, shape and position of the enlarged handle and handle transition portions of the tennis racket handle can be widely varied. For a handle that is 7½ inches long, for example, the tennis racket handle kit of the present invention could be configured so that the base end of the handle transition portion is located about 3½ inches from the base of the handle shaft 6 at point "b." This is the distance at which the V-shaped area between the player's thumb and forefinger would comfortably come to rest on the handle transition portion 13 when the handle is gripped for a normal forehand stroke, as shown in FIG. 2. To accommodate the V-shaped area of the player's hand, the handle transition portion could extend about ¼–¾ inches to the base end of the enlarged handle portion 12. The enlarged handle portion 12 would then extend about 3¼–3¾ inches toward the throat end of the handle shaft to point "a." The total increase in handle width provided by the enlarged handle portion 12 (e.g. w2–w1) could range anywhere from about ¼–1½ inches.

Figure 9A:
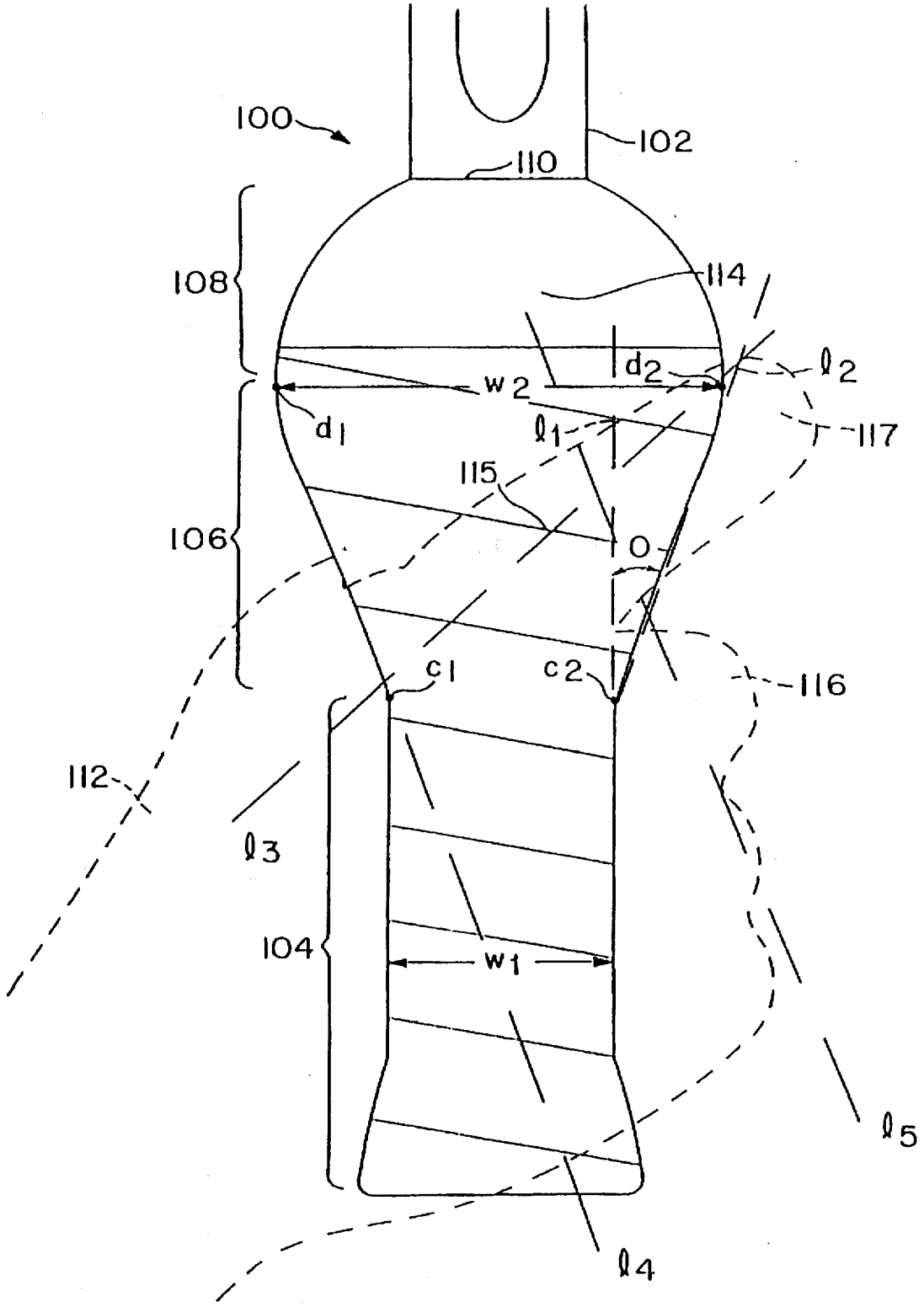
FIG. 9*a* is a partial front view of a novel tennis racket handle configuration which advantageously provides an enlarged handle portion for the placement of names, logos and other advertising indicia.

In the embodiment of FIGS. 9*a* and 9*b*, a tennis racket 100 includes a handle shaft 102 and a first handle portion 104 having a substantially uniform first width dimension w1 and a substantially uniform first depth dimension (not shown). The first handle portion extends to points "c1" and "c2" on each side of the handle. Extending from points "c1" and "c2" is a gently curved handle transition portion 106 which may be formed so as to be substantially in excess of the length of the handle transition portion 13 of the kits shown in FIGS. 1–8. The handle transition portion 106 in FIGS. 9*a* and 9*b* extends from the upper end of the first handle portion 104 at points "c1" and "c2" and extends to the area of the maximum width dimension w2, shown by points "d1" and "d2". In the area of points "c1" and "c2", the handle transition portion 106 has a concave curvature with respect to the player's hand 112. In the area of points "d1" and "d2", the handle transition portion 106 has a convex curvature with respect to the player's hand 112. An enlarged second handle portion 108 extends from points "d1" and "d2" and has a substantially uniform second depth dimension (not shown) which is substantially equal to the first depth dimension of the first handle portion 104, and a maximum width dimension w2 which is substantially larger than the first width dimension w1 of the first handle portion. Because points "d1" and "d2" are the points of maximum width w2, the enlarged handle portion 108 could be partially straight, or could gradually taper inwardly to the upper edge 110 thereof. In FIGS. 9*a* and 9*b*, the enlarged handle portion 108 has a convex curvature relative to the player's hand 112 and tapers inwardly from the points "d1" and "d2" to the upper edge 110. Alternatively, the enlarged handle portion 108 could be concave with respect to the player's hand to provide a "sword" effect. Many other configurations for the enlarged handle portion 108 could also be provided.

Advantageously, the enlarged second handle portion 108, either alone or in combination with the handle transition portion 106, provides a wide, flat area 114, as shown in FIGS. 9*a* and 9*b*, which can be used as an advertising area for displaying names, logos and other advertising indicia for manufacturers, sponsors and the like. For example, FIGS. 9*a* and 9*b* show the trademark "TOMAHAWK" appearing in the advertising area 114. As will be described, it is desirable, but not mandatory, in providing the advertising area 114, to maintain the depth dimension of the handle portion 108 relatively uniform to provide a substantially flat area extending across the width w2 for printing, the substantially flat area preferably being at least as wide as the width w1.

In the configuration of FIGS. 9*a* and 9*b*, points "c1" and "c2" would typically be located about 3½ inches from the base of the handle shaft 102 so that the V-shaped area of the player's hand 112 can be brought comfortably into engagement with the bottom of the handle transition portion 106 when the handle is gripped for a normal forehand stroke. The length of the handle transition portion 106 in the FIGS. 9*a* and 9*b* configuration preferably ranges from about 1–3½ inches, while the enlarged handle portion 108 can range from about ½–3 inches. The increase in handle width provided by the enlarged handle and handle transition portions (i.e. w2–w1) preferably ranges from about 1–1½ inches. The angie θ, whose origin is at either of the points "c1" and "c2," and which measures the angle made by a line extending between the points "c1," "d1," or "c2," "d2," and a line "1" representing an extension of either of the sides of the first handle portion 104, preferably ranges between about 10–60 degrees and, is optimally about 17 degrees. In most cases, the handle transition portion 106 and the enlarged handle portion 108 will be sized so that the player's index finger 115 can be angled upwardly and away from the remaining fingers 116 on a line generally extending from the points "c1" or "c2" on one side of the handle shaft 102, to the points "d2" or "d1," respectively, on the other side of the handle shaft. During forehand strokes, the edge of the racket handle in the vicinity of the points "d1" or "d2" preferably lies under the area of the player's index finger extending between the first joint and the end of the finger. Alternatively, the entire index finger could be positioned to lie across the face of the racket handle between the points "c1" or "c2" and the interior areas of the handle transition portion 106 and the enlarged handle portion 108.

During backhand strokes, the edge of the racket handle in the vicinity of the points "d1" or "d2" preferably lies under the area of the player's thumb 118 extending between the first thumb joint 119 and the end of the thumb. Alternatively, the entire thumb could be positioned to lie across the face of the racket handle between the points "c1" or "c2" and the interior areas of the handle transition portion 106 and the enlarged handle portion 108.

To provide the advantages of an enlarged handle portion, the handle transition portion 106 and the enlarged handle portion 108 should thus be sized and configured so that the area on one side of the handle that is adjacent to the points "c1" and "c2" will provide a comfortable surface, preferably slightly concave in shape, against which the V-shaped area of the player's hand between the thumb and forefinger 117 can comfortably rest, while the area adjacent the points "d1" and "d2" should be configured to engage portions of the player's index finger or thumb in a comfortable fashion by making that area flat or slightly convex in shape. Alternatively, as previously indicated, a sharp concave transition could be provided at the points "d1" and "d2" to support the first or second joint of the player's index finger to provide a "sword effect" for use during forehand strokes.

As shown in FIG. 9*a*, the angle between points "c1," "d1" or "c2," "d2" on each side of the handle is preferably substantially parallel to a line extending generally through the knuckles of the player's hand 112, thus orienting the hand in the manner shown in FIG. 9*a* during forehand strokes, and allowing the forefinger 117 to naturally extend from the points "c1" or "c2" on one side of the handle to the points "d2" or "d1", respectively, on the other side of the handle. Because points "d1" and "d2" represent a widened grip area providing purchase points for the thumb and forefinger, the player's fingers tend to spread apart in a manner which has been determined to provide increased degrees of controlled power during both forehand and backhand strokes.

Figure 10:
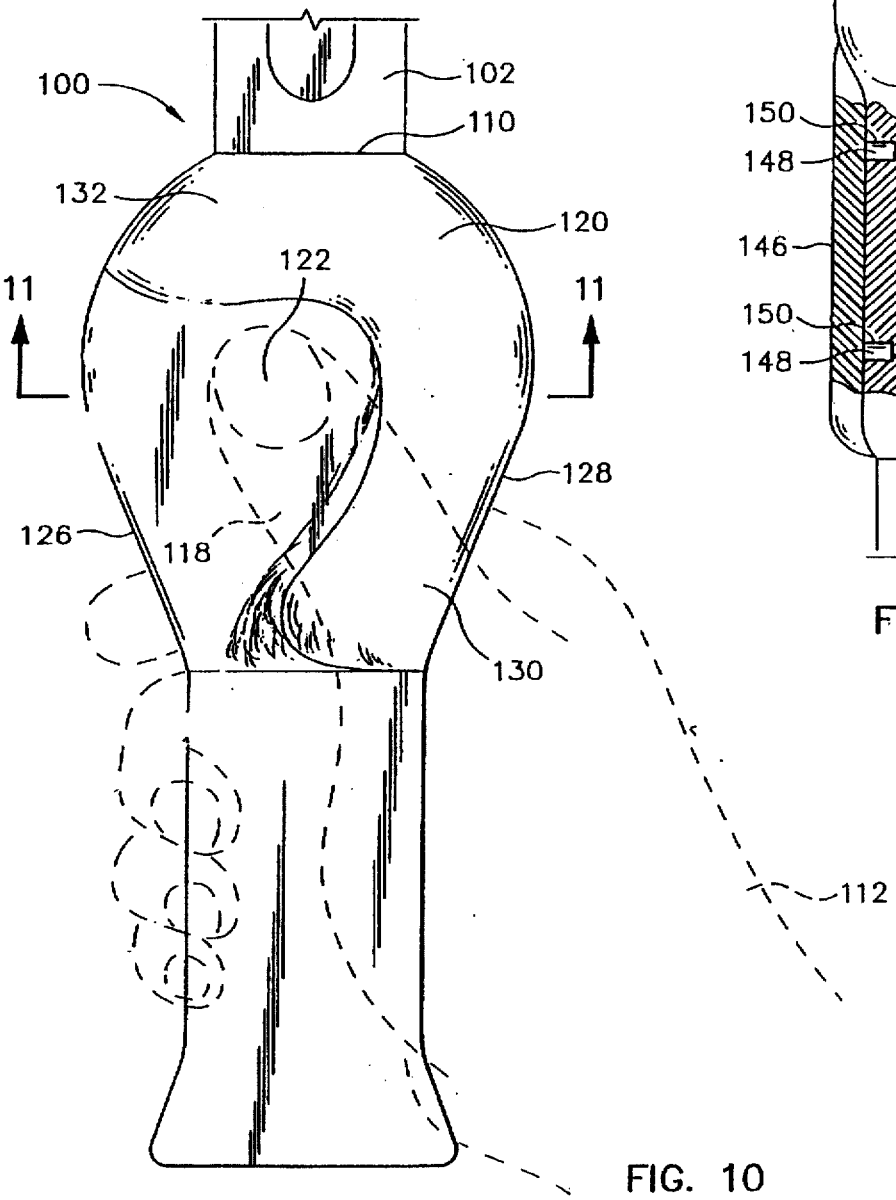
FIG. 10 is a partial front view of an alternative embodiment of the tennis racket handle configuration of FIGS. 9*a* and 9*b*.

Referring to FIG. 10, a further embodiment is illustrated with a modification to the previous embodiment wherein the basic teardrop configuration is retained with modified features which enhance the grip provided. The illustrated grip 120 is formed with a front face 122 and a back face 124 with diverging side edges 126 and 128 extending to and converging sharply back to the primary handle 102. The side edges can converge from about 5 degrees to about 25 degrees with about ten to twenty being preferred. This grip is provided with an enhanced feature comprising a rounded ridge 130 extending from the butt end along one side edge of the front face 122 toward the head end of the enlarged handle portion. This ridge 130 extends at substantially the same angle as the diverging side edge 128 of the enlarged handle portion. This modification provides additional grip area for better control and power on a backhand stroke.

The illustrated grip in its preferred form is preferably formed with each of the front and back faces having a major surface of the area substantially flat, but may preferably have a slight curvature such as a concave front face portion where the thumb normally rests and a somewhat convex back surface to conform to curvature of the hand curled around the grip. In the illustrated embodiment the grip is also formed with a cross or transverse ridge 132 at the head or forward end of the face thereof. This is forward of the area where the thumb normally rests. Thus, the thumb is somewhat surrounded by raised ridges on two sides.

The back face may also be provided with a slight ridge 134 extending transverse to the face thereof at the head end. This is not an essential feature of this embodiment of the grip, however, players have found it to be beneficial in enhancing the grip and control of the racket, particularly for the back-hand.

Figure 11:
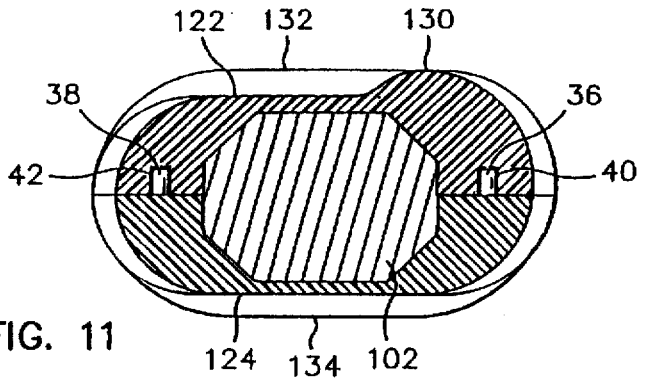
FIG. 11 is a cross-sectional view taken generally on line 11—11 of FIG. 10.

An additional feature of this embodiment, as illustrated in FIG. 11, is a form of attachment of the grip kit to a conventional racket handle. As illustrated in FIG. 11, the units are provided with a pin and socket arrangement which enables the kit to be attached to the handle without regard to the typical enlarged butt end of the racket handle. As illustrated, a pair of pins 136 and 133 on one half portion of the grip extend into bores 138 and 140 on the other grip portion. Preferably, these are constructed for a snap-in lock type of attachment as is typically well-known in the plastics molding industry. The grip may be formed of any suitable material, such as a foamed plastic or other light-weight, but firm, material.

Figure 12:
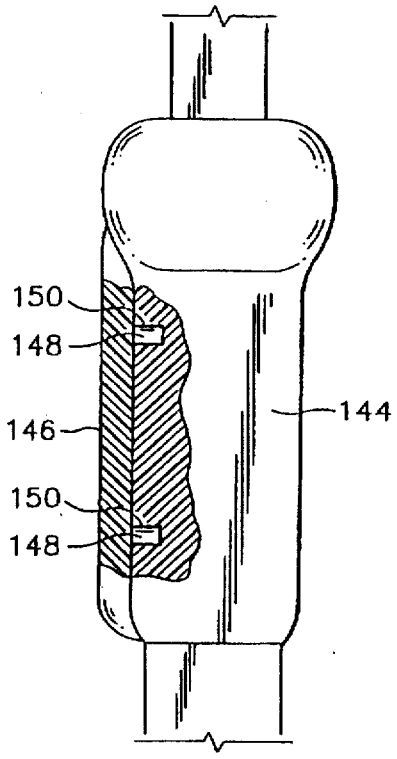
FIG. 12 is a side view partially in section of a variation of the FIG. 10 embodiment.

Referring now to FIG. 12, a modified enlarged grip substantially as in FIG. 10 is provided with a detachable grip or ridge member 146, which preferably extends at an angle substantially as the prior embodiment. This modification includes snap in pins 148 preferably on the ridge member 146 and sockets 150 formed in the face of the grip member 144. This enables the attachment and detachment of the ridge member by the player, at will.

Figure 14:
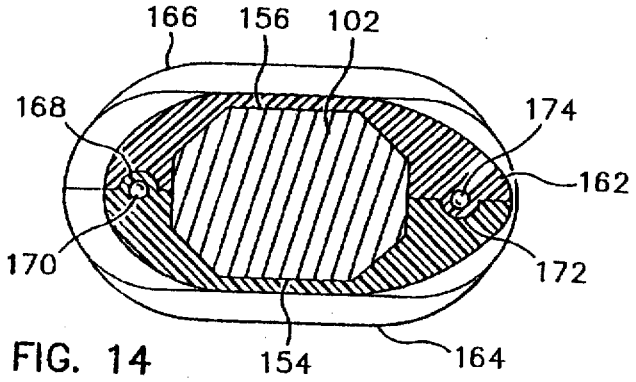
FIG. 14 is a section view taken on line 14—14 of FIG. 13.
Figure 13:
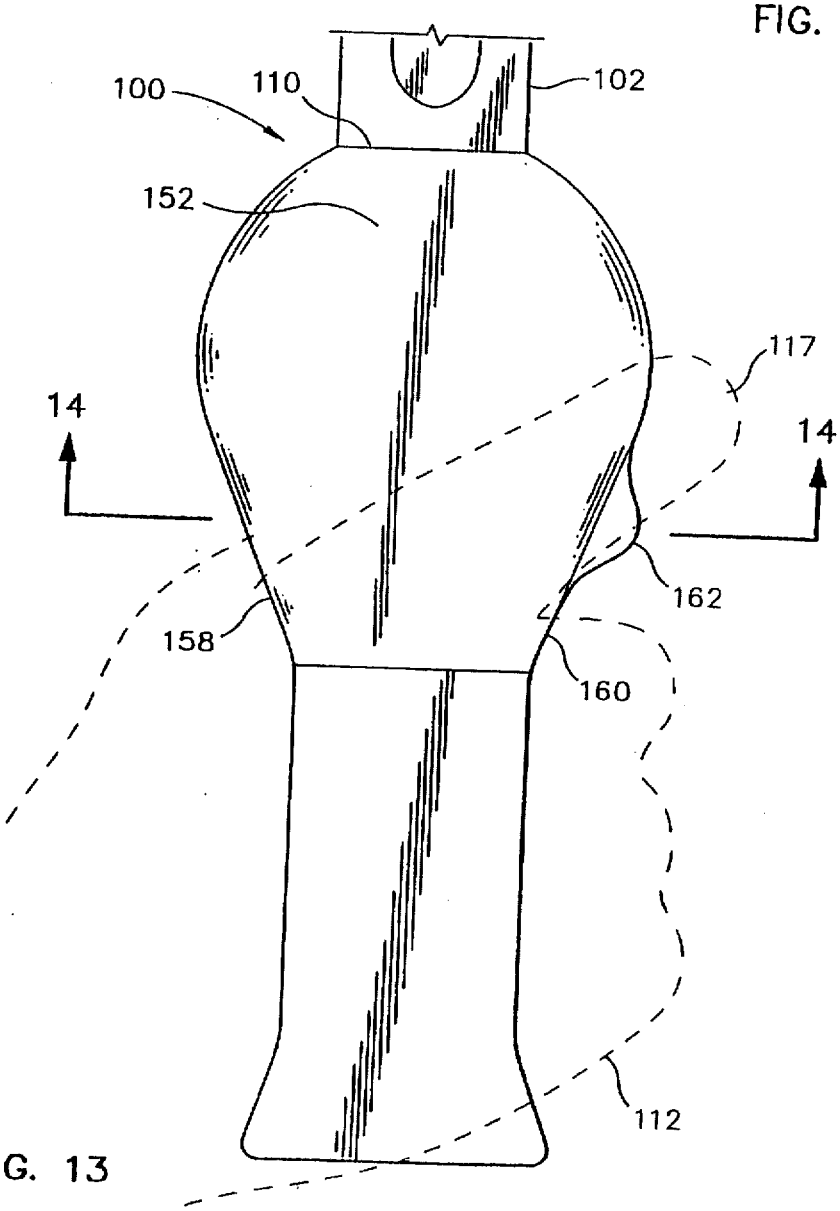
FIG. 13 is a view like FIG. 10 of a further embodiment of the invention.

Referring to FIG. 13, a still further embodiment of the grip 152 is illustrated, having the generally same teardrop configuration with front and back faces 154 and 156 and diverging side edges 158 and 160. In this embodiment, one side edge 160 is provided with a bump or protrusion 162 which I call a trigger for engagement by a forefinger 117 as shown in phantom in FIG. 13. The trigger may be varied in height, in position along the edge and/or around the edge. I have found this to greatly enhance the grip and control of the racket, particularly during certain forehand strokes. In this embodiment the front and back faces may be substantially planar as in prior configurations, or may include certain modifications of the previous embodiment. For example, the grip may also contain the thumb ridge as previously described for enhancing the back hand. Thus, the modified grip may contain both modifications of FIGS. 10 and 13 as in the same embodiment. Referring to FIG. 14, for example, the head end of the grip preferably embodies cross ridges 164 and 166.

An alternate form of attachment of the two halves of the grip member of the kit to the handle 102 is also illustrated in this embodiment. As illustrated the from face half is provided with a loop, as illustrated 168 which cooperatively overlaps a similar loop on the back face half such that bores therein are aligned for receiving a pin 170. Similarly, as illustrated, a loop 172 on the back face member overlaps a loop (not shown) on the front face half and aligned bores thereof receive a pin 174. This attaches the two halves of the unit together around the handle 102.

Figure 15:
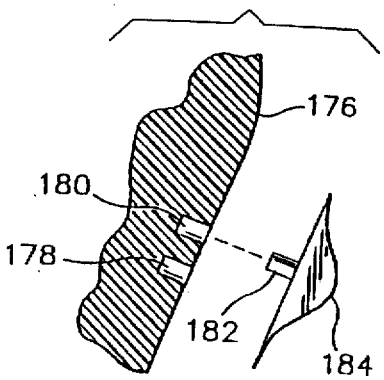
FIG. 15 is a detailed view of a variation of the FIG. 13 embodiment.

Referring to FIG. 15, an alternate embodiment of this embodiment is illustrated, wherein a hand grip 176 is provided along one side edge thereof, one or more pin receiving bores 178 and 180 for receiving a snap in pin 182 of a trigger 184. In this embodiment the two different bores, 178 and 180, are selectively positioned along the side edge of the grip member 176 to optimize the position of the trigger grip. Additional pin receiving bores may be provided to increase the selective positioning of the trigger 184. This can also be embodied in combination with one or more of the embodiments of FIG. 10–12.

While I have illustrated and described my invention by means of specific embodiments, it is to be understood that numerous changes and modifications may be made therein without departing from the spirit and scope of the invention, as defined in the appended claims. For example, the grip does not need to be symmetrical as illustrated but may be asymmetrical to better fit the hand. The illustrated curvatures may also be varied as well as the size and thickness of the grip. The grip may also be varied in position along the length of the handle.

I claim:

1. A tennis racket having a racket head and a handle shaft extending from said racket head, said handle shaft having a substantially uniform first handle portion including a first width dimension and a substantially uniform first depth dimension, comprising:

a pair of inserts forming an enlarged handle portion of said handle shaft having a second width dimension that is larger than said first width dimension and a second depth dimension, said inserts having side edges forming a handle transition portion of said handle shaft diverging at an angle of between about ten and twenty degrees from said first handle portions to said second handle portions toward said head providing a transition between said first and second width dimensions, said inserts forming front and back faces corresponding to faces of the racket head, said front and back faces having surfaces parallel to the racket head.

2. The tennis racket of claim 1 wherein said surfaces are formed with a rounded ridge that extends along a side of said one face at substantially the same angle as said transition.

3. The tennis racket of claim 1 wherein said inserts form a generally truncated teardrop configuration and include a tapered end portion that provides said handle transition portion of said handle shaft.

4. The tennis racket of claim 3 wherein said inserts are mountable on opposing sides of said racket shaft.

5. The tennis racket of claim 4 wherein one of said front and back surfaces is formed with a rounded ridge that extends along a side of said one face at substantially the same angle as said diverging side edges.

6. The tennis racket of claim 5 wherein said inserts have a thickness about equal to the thickness of said shaft.

7. The tennis racket of claim 5 wherein said enlarged handle portion has a cross section that is rounded at one side and converges toward a point at the other side.

8. The tennis racket of claim 1 wherein said inserts have a generally truncated teardrop configuration when viewed face on and include a tapered end portion that provides said handle transition portion of said handle shaft, said structure is formed as one or more second inserts mountable on opposing sides of said racket shaft and are held together by pins extending through aligned bores formed in alternate ones of said inserts.

9. A tennis racket having a handle shaft, the shaft having a butt end and a head end, said handle shaft having a substantially uniform first handle portion including a first width dimension and a substantially uniform first depth dimension, and an attachment, comprising:

a three dimensional structure having from and back faces and opposed side edges forming a truncated teardrop configuration when viewed face on for attachment to a racket handle shaft spaced from the butt end forming an enlarged handle portion of said handle shaft having a width dimension that is larger than said shaft width dimension and a depth dimension, said structure including a tapered end portion forming a handle transition portion of said handle shaft with said side edges diverging at an angle of between about ten and twenty degrees from said shaft to said enlarged handle portions toward said head end providing a transition between said shaft and said enlarged dimensions, said front and back faces corresponding to front and back faces of a racket head, one of said from and back faces forming a substantially flat surface.

10. The tennis racket of claim 9 wherein one of said front and back faces includes a rounded ridge that extends along a side of said one face at substantially the same angle as said diverging side edges.

11. The tennis racket of claim 9 wherein said truncated teardrop configuration when viewed face on includes a transverse rounded ridge across the head end of each face thereof.

* * * * *